US009926817B2

(12) United States Patent
Ikeda et al.

(10) Patent No.: US 9,926,817 B2
(45) Date of Patent: Mar. 27, 2018

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Kenji Ikeda, Gotenba (JP); Yuji Noguchi, Obu (JP); Takeo Asahi, Kariya (JP); Hiroyuki Hamasaki, Obu (JP); Yoshiaki Iguchi, Toyohashi (JP); Tomohiro Kajita, Anjo (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 63 days.

(21) Appl. No.: 15/034,466

(22) PCT Filed: Nov. 18, 2014

(86) PCT No.: PCT/JP2014/080423

§ 371 (c)(1),
(2) Date: May 4, 2016

(87) PCT Pub. No.: WO2015/079962

PCT Pub. Date: Jun. 4, 2015

(65) Prior Publication Data

US 2016/0281549 A1 Sep. 29, 2016

(30) Foreign Application Priority Data

Nov. 29, 2013 (JP) ..... 2013-248164

(51) Int. Cl.
*F01L 1/34* (2006.01)
*F01L 1/344* (2006.01)
*F01L 1/348* (2006.01)

(52) U.S. Cl.
CPC ..... *F01L 1/3442* (2013.01); *F01L 1/348* (2013.01); *F01L 2001/34423* (2013.01);
(Continued)

(58) Field of Classification Search
CPC ..... F01L 1/3442; F01L 1/348; F01L 2001/34483; F01L 2001/34453;
(Continued)

(56) References Cited

U.S. PATENT DOCUMENTS

2003/0037741 A1 2/2003 Kohrs
2004/0107930 A1 6/2004 Miura
(Continued)

FOREIGN PATENT DOCUMENTS

DE 101 34 320 A1 1/2003
JP 2000-161028 A 6/2000
(Continued)

OTHER PUBLICATIONS

Notification of Transmittal of Translation of the International Preliminary Report on Patentability (Forms PCT/IB/373 and the Written Opinion of the International Searching Authority (Form PCT/ISA/237) dated May 31, 2016, by the International Bureau of WIPO in corresponding International Application No. PCT/JP2014/080423. (7 pages).
(Continued)

*Primary Examiner* — Zelalem Eshete
(74) *Attorney, Agent, or Firm* — Buchanan Ingersoll & Rooney PC

(57) ABSTRACT

The valve opening/closing timing control device includes: a driving rotating body; a driven rotating body; a fixed shaft portion; a fluid pressure chamber; a partitioning portion; and a phase control unit for controlling a rotation phase by supplying/discharging pressurized fluid to/from an advancing chamber or a retarding chamber via an inside of the fixed shaft portion. The driven rotating body has: an inner circumferential member with a cylindrical portion, and a coupling plate portion of the camshaft, the cylindrical portion and the coupling plate portion being integrated with
(Continued)

each other; and an outer circumferential member provided with the partitioning portion. The outer circumferential member includes the inner circumferential member in a unified manner so as to have the same rotational axis. The inner circumferential member is formed with an iron-based material. The outer circumferential member is formed with a material that is lighter in weight than the iron-based material.

3 Claims, 6 Drawing Sheets

(52) U.S. Cl.
CPC ..... *F01L 2001/34426* (2013.01); *F01L 2001/34453* (2013.01); *F01L 2001/34483* (2013.01); *F01L 2103/00* (2013.01)

(58) Field of Classification Search
CPC ... F01L 2001/34426; F01L 2001/34423; F01L 2103/00
USPC ..... 123/90.17
See application file for complete search history.

(56) References Cited

U.S. PATENT DOCUMENTS

| | | | | |
|---|---|---|---|---|
| 2007/0251475 | A1* | 11/2007 | Suga ..... | F01L 1/34 123/90.17 |
| 2012/0174884 | A1 | 7/2012 | Shinomiya | |
| 2014/0090612 | A1 | 4/2014 | Hayashi et al. | |

FOREIGN PATENT DOCUMENTS

| | | | |
|---|---|---|---|
| JP | 2010-031821 | A | 2/2010 |
| JP | 2014-080968 | A | 5/2014 |

OTHER PUBLICATIONS

International Search Report (PCT/ISA/210) dated Jan. 27, 2015, by the Japanese Patent Office as the International Searching Authority for International Application No. PCT/JP2014/080423.
Written Opinion (PCT/ISA/237) dated Jan. 27, 2015, by the Japanese Patent Office as the International Searching Authority for International Application No. PCT/JP2014/080423.

* cited by examiner

VALVE OPENING/CLOSING TIMING CONTROL DEVICE

TECHNICAL FIELD

The present invention relates to a valve opening/closing timing control device that includes: a driving rotating body that rotates in synchronization with a crankshaft of an internal combustion engine; and a driven rotating body that rotates in synchronization with a camshaft for opening/closing a valve of the internal combustion engine.

BACKGROUND ART

In order to reduce the weight of the driven rotating body while ensuring the strength thereof, Patent Document 1 discloses a valve opening/closing timing control device that includes a driven rotating body that is configured with: a cylindrical outer circumferential member that is made of a lightweight aluminum-based material; and a cylindrical inner circumferential member that is made of an iron-based material having a higher strength than the aluminum-based material, the outer circumferential member and the inner circumferential member being integrated into one piece so as to have the same rotational axis.

This valve opening/closing timing control device is configured to control the rotation phase of the driven rotating body relative to the driving rotating body by supplying/discharging a pressurized fluid to/from an advancing chamber or a retarding chamber from the camshaft side via an advancing channel or a retarding channel.

CITATION LIST

Patent Literature

Patent Document 1: JP 2000-161028A

SUMMARY OF INVENTION

Technical Problem

In the above-described conventional valve opening/closing timing control device, an aluminum-based material is used in the outer circumferential member, and therefore the strength of the driven rotating body is lower than the strength of a prior driven rotating body that is configured with only an iron-based material. However, in the case of the above-described conventional technology, only a pressurized fluid supply channel and an insertion hole for a bolt for connecting the inner circumferential member to the camshaft are formed in the inner circumferential member, and the amount of reduction in the volume of the inner circumferential member is limited. Therefore, although the overall strength of the driven rotating body according to the above-described conventional technology is reduced, the strength is maintained at a required level.

In contrast, there is a so-called front feed type driven rotating body to/from which a pressurized fluid is supplied/discharged from the opposite side to the camshaft. In this case, a fixed shaft portion that supplies the pressurized fluid is inserted into a recessed portion that is formed in the center of the inner circumferential member. However, the fixed shaft portion is likely to be large in size because the fixed shaft portion is provided with a channel for supplying/discharging the pressurized fluid, as well as a seal member or the like that is to be located at the boundary between the fixed shaft portion and the inner circumferential member. Also, it is necessary to secure an area in which a portion of the bolt for coupling with the camshaft can be housed, within the recessed portion of the inner circumferential member. Therefore, it is necessary to form a relatively large recessed portion in the central portion of the inner circumferential member, and consequently the strength of the inner circumferential member is considerably lower than the strength of the above-described conventional technology.

In this way, front feed type valve opening/closing timing control devices still have points to be improved, e.g., it is difficult to ensure the strength if an aluminum-based material is used in a portion of the driven rotating body.

The present invention has been made in view of the above-described situation, and aims to provide a valve opening/closing timing control device that makes it easy to reduce the weight of the driven rotating body while ensuring the strength thereof, despite having a front feed type structure in which the inner circumference side of the driven rotating body is supported by the fixed shaft portion.

Solution to Problem

A characteristic configuration of a valve opening/closing timing control device according to one aspect of the present invention lies in that the valve opening/closing timing control device includes: a driving rotating body that rotates in synchronization with a crankshaft of an internal combustion engine; a driven rotating body that is located on an inner circumference side of the driving rotating body so as to be relatively rotatable, and that rotates in synchronization with a camshaft for opening/closing a valve of the internal combustion engine; a fixed shaft portion by which an inner circumferential part of the driven rotating body is supported so as to be rotatable about a rotational axis that is the same as a rotational axis of the driving rotating body; a fluid pressure chamber that is formed between the driving rotating body and the driven rotating body; an advancing chamber and a retarding chamber that are formed by partitioning the fluid pressure chamber with a partitioning portion that is provided on an outer circumference side of the driven rotating body; an advancing channel that is in communication with the advancing chamber, and a retarding channel that is in communication with the retarding chamber, the advancing channel and the retarding channel being formed in the driven rotating body; and a phase control unit for controlling a rotation phase of the driven rotating body relative to the driving rotating body such that a pressurized fluid is selectively supplied/discharged to/from the advancing chamber or the retarding chamber via an inside of the fixed shaft portion and via the advancing channel or the retarding channel, and that the driven rotating body has: an inner circumferential member that has a cylindrical portion into which the fixed shaft portion is inserted, and a coupling plate portion for coupling the camshaft to one end portion of the cylindrical portion, the cylindrical portion and the coupling plate portion being integrated with each other; and a cylindrical outer circumferential member that is located on an outer circumference side of the inner circumferential member and is provided with the partitioning portion, the outer circumferential member is provided with the inner circumferential member in a unified manner so as to have the same rotational axis, the inner circumferential member is formed with an iron-based material, and the outer circumferential member is formed with a material that is lighter in weight than the iron-based material.

The valve opening/closing timing control device having this configuration includes: a fixed shaft portion by which an inner circumferential part of the driven rotating body is supported so as to be rotatable about a rotational axis that is the same as a rotational axis of the driving rotating body; and a phase control unit for controlling a rotation phase of the driven rotating body relative to the driving rotating body such that a pressurized fluid is selectively supplied to or discharged from the advancing chamber or the retarding chamber via an inside of the fixed shaft portion and via the advancing channel or the retarding channel. In other words, the inner circumferential part of the driven rotating body is supported by the fixed shaft portion, which tends to have a large diameter because a pressurized fluid is selectively supplied to or discharged from the advancing chamber or the retarding chamber via the inside of the fixed shaft portion, and via the advancing channel or the retarding channel.

Therefore, when providing the driven rotating body configured with the outer circumferential member and the inner circumferential member that are unified with each other and have the same rotational axis, if the wall thickness of the inner circumferential member made of an iron-based material is increased in order to ensure the strength of the driven rotating body, the wall thickness of the outer circumferential member is reduced, and it is difficult to reduce the weight of the driven rotating body.

For this reason, in this configuration, the driven rotating body has: an inner circumferential member that has a cylindrical portion into which the fixed shaft portion is inserted, and a coupling plate portion for coupling the camshaft to one end portion of the cylindrical portion, the cylindrical portion and the coupling plate portion being integrated with each other; and a cylindrical outer circumferential member that is located on an outer circumference side of the inner circumferential member and is provided with the partitioning portion. The outer circumferential member is provided with the inner circumferential member in a unified manner so as to have the same rotational axis, the inner circumferential member is formed with an iron-based material, and the outer circumferential member is formed with a material that is lighter in weight than the iron-based material.

In other words, in order to ensure the strength of the inner circumferential member when providing the driven rotating body configured with the outer circumferential member and the inner circumferential member that are coaxially unified with each other, the inner circumferential member that has a coupling plate portion integrated therewith for coupling the camshaft to one end portion of the cylindrical portion, and has a high shape rigidity, is formed with an iron-based material in addition to the cylindrical portion into which the fixed shaft portion is inserted, and the outer circumferential member is formed with a material that is lighter in weight than the iron-based material.

For this reason, it is possible to increase the rigidity of the inner circumferential member that is formed with the iron-based material, without increasing the wall thickness thereof, and to reduce the weight of the driven rotating body while ensuring a large wall thickness of the outer circumferential member that is formed with a lightweight material. Therefore, the valve opening/closing timing control device having this configuration makes it easier to reduce the weight of the driven rotating body while ensuring the strength thereof, despite having a structure in which the inner circumference side of the driven rotating body is supported by the fixed shaft portion.

Another characteristic configuration of one aspect of the present invention lies in that an opening part of the cylindrical portion extends further in a direction along the rotational axis than a part which is provided with the outer circumferential member in a unified manner.

This configuration makes it possible to increase the rigidity of the opening part of the cylindrical portion, and to prevent the cylindrical portion from deforming due to a difference in the coefficient of thermal expansion of the outer circumferential member and the inner circumferential member, for example.

Another characteristic configuration of one aspect of the present invention lies in that the cylindrical portion has: a small-diameter portion that is provided with the coupling plate portion; and a large-diameter portion that is provided with a protruding part provided within a space defined inside the partitioning portion, that is continuous with the small-diameter part, and that has external dimensions that are greater than external dimensions of the small-diameter portion, the small-diameter portion and the large-diameter portion being integrated with each other, and the outer circumferential member is provided on the outer circumference side of the large-diameter portion in a unified manner.

With this configuration, it is possible to approximate the wall thickness of a portion of the outer circumferential member that covers the large-diameter portion to the wall thickness of a portion of the outer circumferential member that covers the protruding part while further increasing the rigidity of the inner circumferential member, by appropriately setting the external dimensions of the large-diameter portion. For this reason, it is possible to prevent the relative deformation areas of the outer circumferential member relative to the inner circumferential member, which are generated due to, for example, the difference in the coefficient of thermal expansion of the outer circumferential member and the inner circumferential member, from being localized between partitioning portions that are adjacent to each other in the circumferential direction, and to disperse the relative deformation areas to a portion that covers the protruding portion as well. Therefore, it is possible to prevent the outer circumferential member and the inner circumferential member from, for example, being separated from each other at the interface therebetween due to the deformation of the outer circumferential member relative to the inner circumferential member.

Another characteristic configuration of one aspect of the present invention lies in that two end surfaces of the large-diameter portion in a direction along the rotational axis have a part that is in contact with the driving rotating body, and a length of the outer circumferential member in the direction along the rotational axis is shorter than a length of an interval between the two end surfaces of the large-diameter portion in the direction along the rotational axis.

With this configuration, it is possible to form the parts of the driven rotating body, which are in contact with the driving rotating body, with an iron-based material, and it is therefore possible to suppress the contacting parts from wearing, and to prevent "rattling" of the driving rotating body and the driven rotating body occurring in the direction along the rotational axis, over a long period.

DESCRIPTION OF EMBODIMENTS

The following describes embodiments of the present invention with reference to the drawings.

First Embodiment

Figure 1:
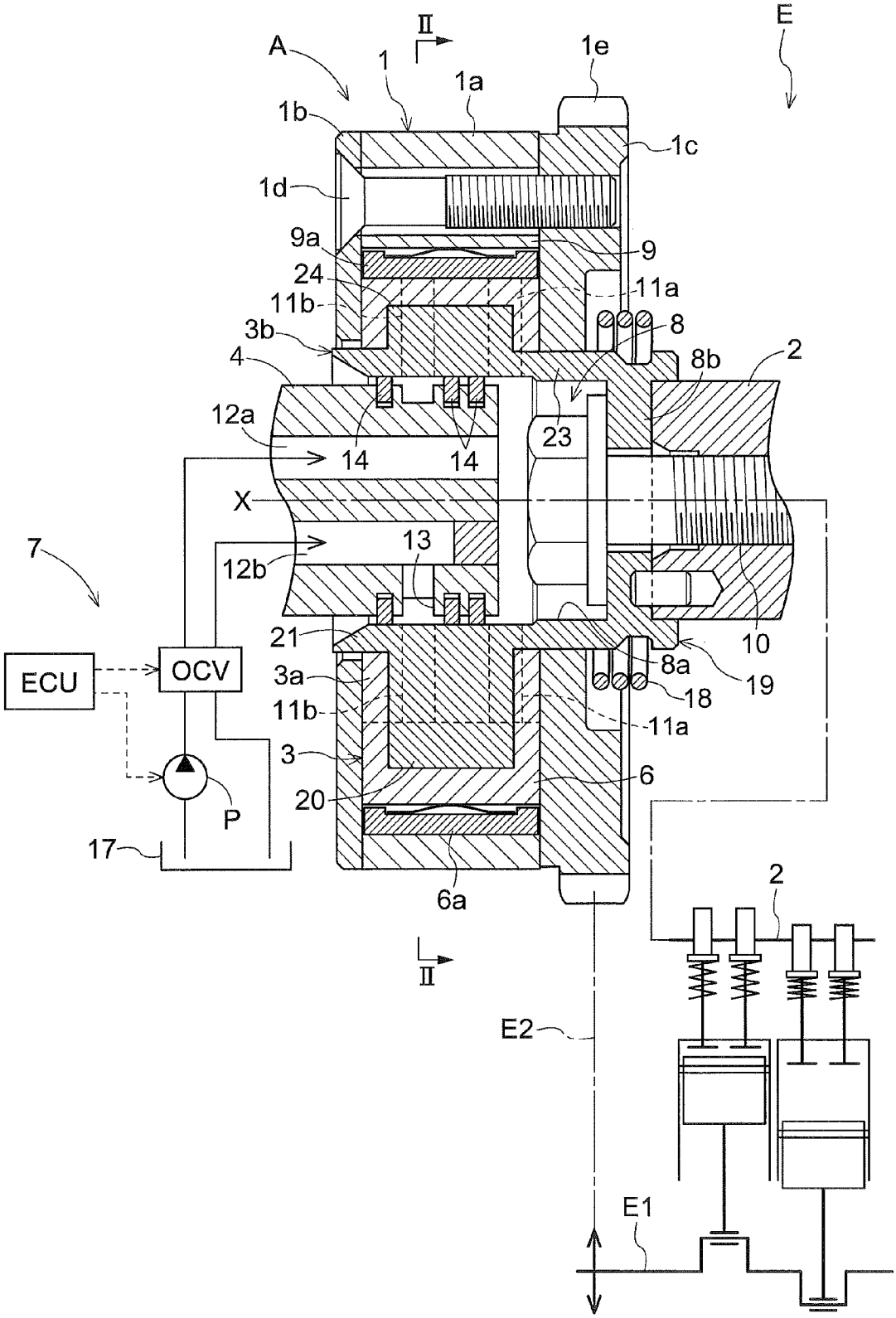
FIG. 1 is a vertical cross-sectional view showing a valve opening/closing timing control device according to a first embodiment.
Figure 2:
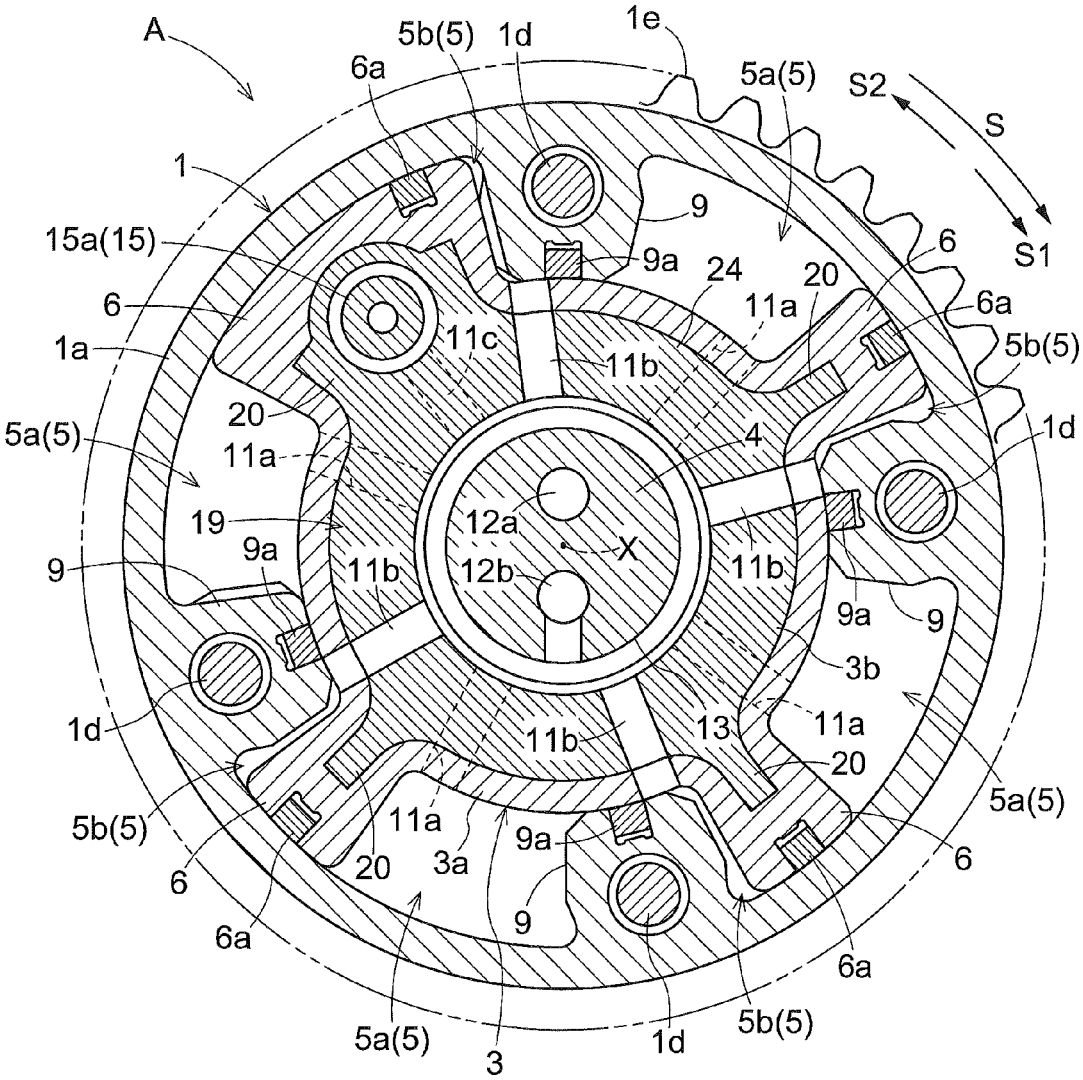
FIG. 2 is a cross-sectional view along a line II-II in FIG. 1 seen in a direction indicated by arrows.

FIG. 1 to FIG. 5 show a valve opening/closing timing control device A according to one aspect of the present invention, which is to be installed to a gasoline engine (internal combustion engine) E for automobiles. As shown in FIG. 1 and FIG. 2, the valve opening/closing timing control device A includes: a housing 1 serving as a "driving rotating body" that rotates in synchronization with a crankshaft E1 of an engine E; an inner rotor 3 serving as a "driven rotating body" that is located on the inner circumference side of the housing 1 so as to be relatively rotatable, and that rotates in synchronization with a camshaft 2 for opening/closing a valve of the engine E; a fixed shaft portion 4 by which an inner circumferential part of the inner rotor 3 is supported so as to be rotatable about a rotational axis that is the same as a rotational axis X of the housing 1; fluid pressure chambers 5 that are formed between the housing 1 and the inner rotor 3; advancing chambers 5*a* and retarding chambers 5*b* that are formed by partitioning the fluid pressure chambers 5 with partitioning portions 6 that are provided on the outer circumference side of the inner rotor 3 integrally therewith; advancing channels 11*a* that are in communication with the advancing chambers 5*a* and retarding channels 11*b* that are in communication with the retarding chambers 5*b*, the advancing channels 11*a* and the retarding channels 11*b* being formed in the inner rotor 3; and a phase control unit 7 for controlling the rotation phase of the inner rotor 3 relative to the housing 1 by using hydraulic oil (engine oil) serving as a "pressurized fluid" selectively supplied/discharged to/from the advancing chambers 5*a* or the retarding chambers 5*b* via the inside of the fixed shaft portion 4 and via the advancing channels 11*a* or the retarding channels 11*b*. The camshaft 2 is rotatably attached to a cylinder head (not shown in the drawings) of the engine E. The fixed shaft portion 4 is fixed to a static member such as a front cover of the engine E.

The housing 1 includes: an outer rotor 1*a* having a cylindrical outer circumferential shape; a front plate 1*b* that is located on the front side of the outer rotor 1*a*; and a rear plate 1*c* that is located on the rear side of the outer rotor 1*a*, which are fixed to each other with coupling bolts 1*d* and are integrated into one piece. The outer rotor 1*a* and the front plate 1*b* are formed with an aluminum-based material such as an aluminum alloy that is lighter in weight than iron-based materials. The rear plate 1*c* includes a sprocket 1*e* that is provided on the outer circumference side of the rear plate 1*c* integrally therewith, and is formed with an iron-based material such as steel.

A power transmission member E2 such as a timing chain or a timing belt is wound around the sprocket 1*e* and a sprocket that is attached to the crankshaft E1, and the housing 1 rotates in the direction indicated by an arrow S shown in FIG. 2 as the engine E is driven.

The inner rotor 3 is fixed to a tip portion of the camshaft 2 that is provided with a cam (not shown in the drawings) that controls opening/closing of an intake valve or an exhaust valve of the engine E. The inner rotor 3 is driven to rotate in the direction indicated by the arrow S along with the rotation of the housing 1.

The inner rotor 3 is provided with a recessed portion 8 that has a cylindrical inner circumferential surface 8*a* that is coaxial with the rotational axis X, and a coupling plate portion 8*b* for coupling with the camshaft 2. The inner rotor 3 and the camshaft 2 are fixed to each other and are integrated into one piece by screwing a bolt 10, which has been inserted into the coupling plate portion 8*b*, into the camshaft 2 coaxially therewith. A torsion coil spring 18 that biases the rotation phase of the inner rotor 3 relative to the housing 1 toward the advance side is attached so as to span the inner rotor 3 and the rear plate 1*c*.

A plurality of protruding portions 9 (four in the present embodiment) that protrude inward in the radial direction are formed on the inner circumference side of the outer rotor 1*a* integrally therewith, at positions that are separated from each other in the rotation direction. Each protruding portion 9 is provided such that a protruding end portion thereof is slidable along the outer circumferential surface of the inner rotor 3 with a seal member 9*a* therebetween.

Four fluid pressure chambers 5 are formed between the protruding portions 9 that are adjacent to each other in the rotation direction, and between the outer rotor 1*a* and the inner rotor 3. The coupling bolts 1*d* are respectively inserted through the protruding portions 9, by which the outer rotor 1*a*, the front plate 1*b*, and the rear plate 1*c* are fixed to each other and are integrated into one piece.

A plurality of partitioning portions 6 (four in the present embodiment) that protrude outward in the radial direction are formed at positions that respectively face the fluid pressure chambers 5 on the outer circumference side of the inner rotor 3 integrally therewith and are separated from each other in the rotation direction. Each partitioning portion 6 is provided such that a protruding end portion thereof is slidable along the inner circumferential surface of the outer rotor 1*a* with a seal member 6*a* therebetween. Each fluid pressure chamber 5 is partitioned by the corresponding partitioning portion 6 into an advancing chamber 5*a* and a retarding chamber 5*b* that are adjacent to each other in the rotation direction.

In the inner rotor 3, advancing channels 11*a* that each have a circular cross section and are in communication with the advancing chambers 5*a*, and retarding channels 11*b* that each have a circular cross section and are in communication with the retarding chambers 5*b*, are formed to penetrate through the inner rotor 3 in the radial direction of rotation and to be in communication with the inner circumference side, specifically the recessed portion 8, of the inner rotor 3. Hydraulic oil is supplied to or discharged from the advancing chambers 5*a* via the advancing channels 11*a*, and is supplied to or discharged from the retarding chambers 5*b* via the retarding channels 11*b*.

The advancing channels 11*a* and the retarding channels 11*b* are formed between the partitioning portions 6 that are adjacent to one another in the rotation direction, so as to be displaced from each other in the direction of the rotational axis X as shown in FIG. 1, and so as to be out of phase with each other around the rotational axis X as shown in FIG. 2.

As shown in FIG. 1, the advancing channels 11*a* are in communication with the recessed portion 8 at positions that are on the rear plate 1*c* side and that face a space between the fixed shaft portion 4 and the coupling plate portion 8*b*, and the retarding channels 11*b* are in communication with the recessed portion 8 at positions that are closer to the front plate 1*b* than the advancing channels 11*a* are and that face the outer circumferential surface of the fixed shaft portion 4.

The fixed shaft portion 4 has: an advance-side supply channel 12*a* serving as a fluid channel that can be in communication with the advancing channels 11*a*; and a retard-side supply channel 12*b* serving as a fluid channel that can be in communication with the retarding channels 11*b*. The advance-side supply channel 12*a* is in communication with the space between the fixed shaft portion 4 and the coupling plate portion 8*b* from one end side of the fixed shaft portion 4 in the axial direction thereof, and the retard-side supply channel 12*b* is in communication with a ring-shaped circumferential groove 13 that is formed in the outer circumferential surface of the fixed shaft portion 4. Seal rings 14 that fill the gap between the outer circumferential surface of the fixed shaft portion 4 and the inner circumferential surface 8*a* of the recessed portion 8 are attached to both sides of the ring-shaped circumferential groove 13 and one end side of the fixed shaft portion 4 in the axial direction.

A lock mechanism 15 that can switch to a locked state in which the lock mechanism 15 restrains the rotation phase of the inner rotor 3 relative to the housing 1 at the maximum retard position, and to an unlocked state in which the lock mechanism 15 releases the restraint, is provided to span one of the partitioning portions 6 included in the inner rotor 3, and the housing 1. The lock mechanism 15 is configured by attaching a lock member 15*a* to one of the partitioning portions 6 of the inner rotor 3, the lock member 15*a* having a tip portion that can protrude and retract in the direction along the rotational axis X relative to a recessed portion (not shown in the drawings) formed in the rear plate 1*c*.

The lock mechanism 15 switches to the locked state upon the tip portion of the lock member 15*a* becoming embedded in the recessed portion of the rear plate 1*c* due to the biasing force of a biasing member (not shown in the drawings) such as a compression spring, and switches to the unlocked state upon the tip portion exiting the recessed portion of the rear plate 1*c* toward the inner rotor 3 side, moving against the biasing force of the biasing member, due to the pressure of the hydraulic oil supplied via a lock oil channel 11*c* that is in communication with the ring-shaped circumferential groove 13.

The phase control unit 7 includes: an oil pump P that sucks/discharges hydraulic oil within an oil pan 17; a fluid control valve OCV that supplies/discharges hydraulic oil to/from the advance-side supply channel 12*a* and the retard-side supply channel 12*b*, and interrupts the supply/discharge of hydraulic oil; and an electronic control unit ECU that controls the actions of the fluid control valve OCV.

The rotation phase of the inner rotor 3 relative to the housing 1 is displaced in the advance direction (the direction of increasing the capacities of the advancing chambers 5*a*) indicated by the arrow S1, or in the retard direction (the direction of increasing the capacities of the retarding chambers 5*b*) indicated by the arrow S2 by a hydraulic oil supplying/discharging operation of the phase control unit 7, and the rotation phase is maintained at a given phase by a hydraulic oil supply/discharge interrupting operation. The lock mechanism 15 switches from the locked state to the unlocked state upon hydraulic oil being supplied via the lock oil channel 11*c* in response to an operation to supply hydraulic oil to the advancing chambers 5*a*.

Figure 3:
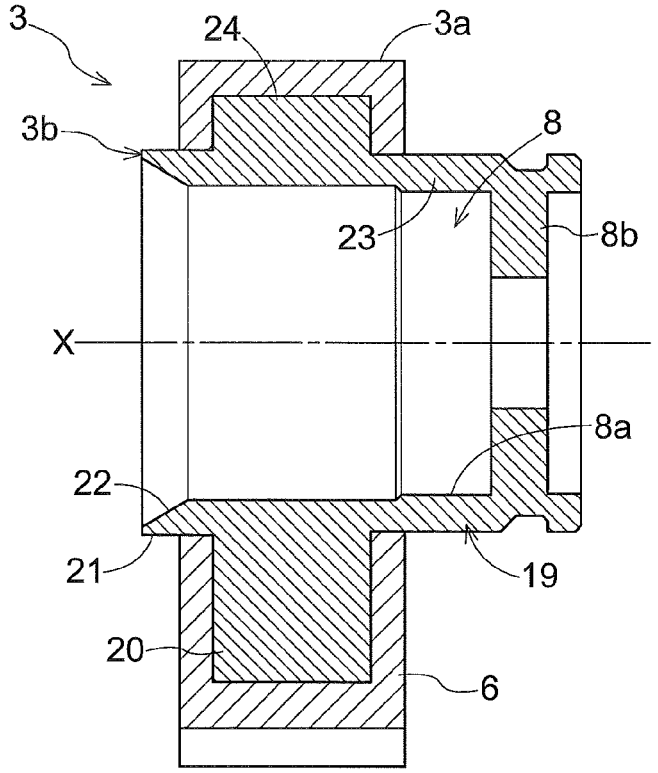
FIG. 3 is a vertical cross-sectional view of an inner rotor (a driven rotating body).
Figure 4:
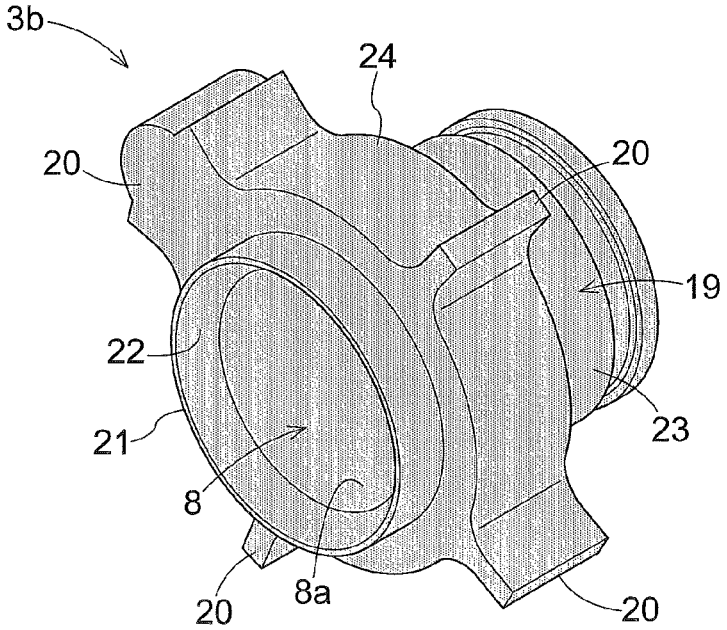
FIG. 4 is a perspective view of an inner circumferential member.
Figure 5:
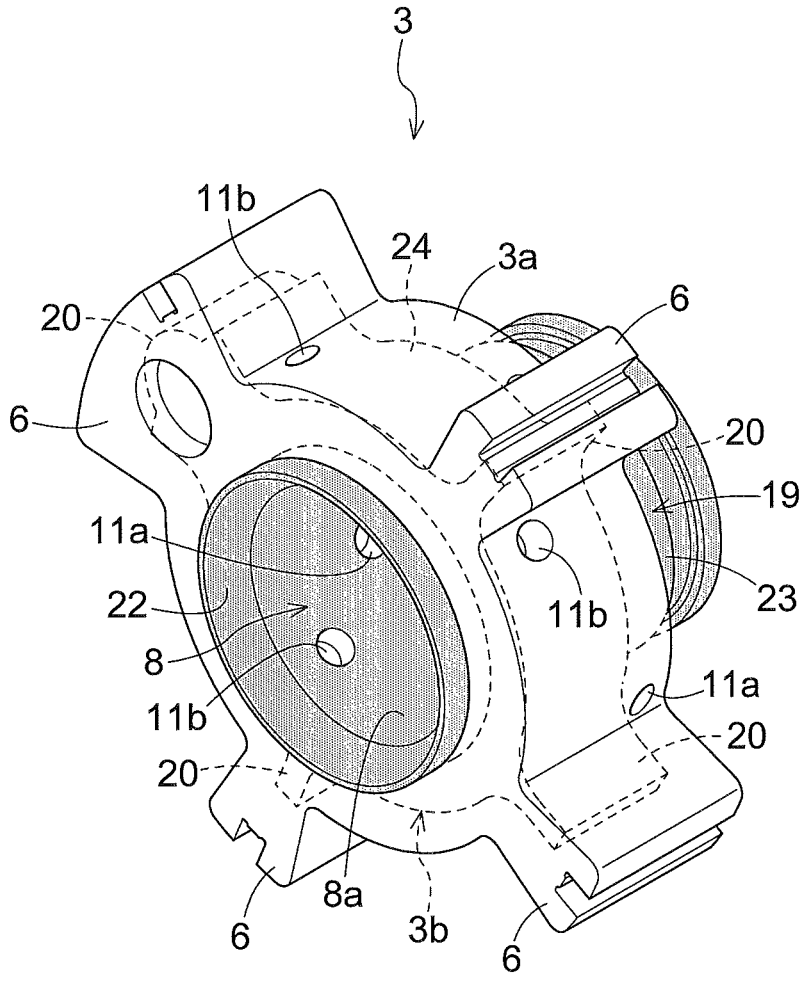
FIG. 5 is a perspective view of the inner rotor.

As shown in FIG. 3 to FIG. 5 as well, the inner rotor 3 has: a cylindrical inner circumferential member 3*b*; and a cylindrical outer circumferential member 3*a* that is located on the outer circumference side of the inner circumferential member 3*b*, and that are integrated with the partitioning portions 6 provided on the outer circumference side of the cylindrical outer circumferential member 3*a*. The outer circumferential member 3*a* is provided with the inner circumferential member 3*b* in a unified manner so as to have the same rotational axis.

The inner circumferential member 3*b* has: a cylindrical portion 19 into which the fixed shaft portion 4 is inserted; the coupling plate portion 8*b* that is located on one end portion of the cylindrical portion 19; and four protruding parts 20 that are respectively provided within spaces that are defined inside the partitioning portions 6 (i.e. respectively embedded in the partitioning portions 6), the cylindrical portion 19, the coupling plate portion 8*b*, and the protruding parts 20 being integrated with each other, and the inner circumferential member 3*b* is configured with, for example, a high-strength sintered or forged article that has been formed with an iron-based material. The lock member 15*a* is attached to one of the protruding parts 20.

The outer circumferential member 3*a* is formed with a material that is lighter in weight than the iron-based material with which the inner circumferential member 3*b* is formed, specifically an aluminum-based material such as an aluminum alloy, for example. The outer circumferential member 3*a* is provided on the outer circumference side of the cylindrical portion 19 in a unified manner, in the state of being prevented from rotating, by, using insert casting, enveloping the outer circumferential portion of the inner circumferential member 3*b* together with the protruding parts 20, with the aluminum-based material with which the outer circumferential member 3*a* is formed.

An opening part 21 of the cylindrical portion 19, into which the fixed shaft portion 4 is inserted, extends further toward the front plate 1*b* side in the direction along the rotational axis X than a part which is provided with the outer circumferential member 3*a* in a unified manner. Therefore, when the inner circumferential member 3*b* is enveloped in the outer circumferential member 3*a* using insert casting, the aluminum-based material that has been fused is unlikely to flow to the inner circumference side of the inner circumferential member 3*b* from the opening part 21. An inner circumferential surface 22 of the opening part 21 is formed to be a tapered surface whose diameter decreases in the direction toward the outer circumferential member 3*a* side (the deeper side), so as to serve as an insertion guide for the fixed shaft portion 4.

The cylindrical portion 19 has: a small-diameter portion 23 that has one end portion provided with the coupling plate portion 8*b*; and a large-diameter portion 24 that is continuous with the small-diameter portion 23 and that has external dimensions that are greater than the external dimensions of the small-diameter portion 23, the small-diameter portion 23 and the large-diameter portion 24 being integrated with each other. In other words, the large-diameter portion 24 is provided around the small-diameter portion 23 and increases the diameter. The large-diameter portion 24 is located on an intermediate portion of the small-diameter portion 23 in the longitudinal direction, and the protruding parts 20 are provided on the outer circumference side of the large-diameter portion 24 integrally therewith.

The outer circumferential member 3*a* is provided on the outer circumference side of the large-diameter portion 24 in a unified manner such that the entirety of the large-diameter portion 24 and the protruding parts 20, including both end surfaces that face in the direction along the rotational axis X, are enveloped using insert casting. Therefore, it is possible to increase the external dimensions of the large-diameter portion 24 to be greater than the external dimensions of the small-diameter portion 23, and to approximate the wall thickness of a portion of the outer circumferential member 3*a* that covers the large-diameter portion 24 to the wall thickness of a portion of the outer circumferential member 3*a* that covers the protruding parts 20, while further increasing the rigidity of the inner circumferential member 3*b*.

Second Embodiment

Figure 6:
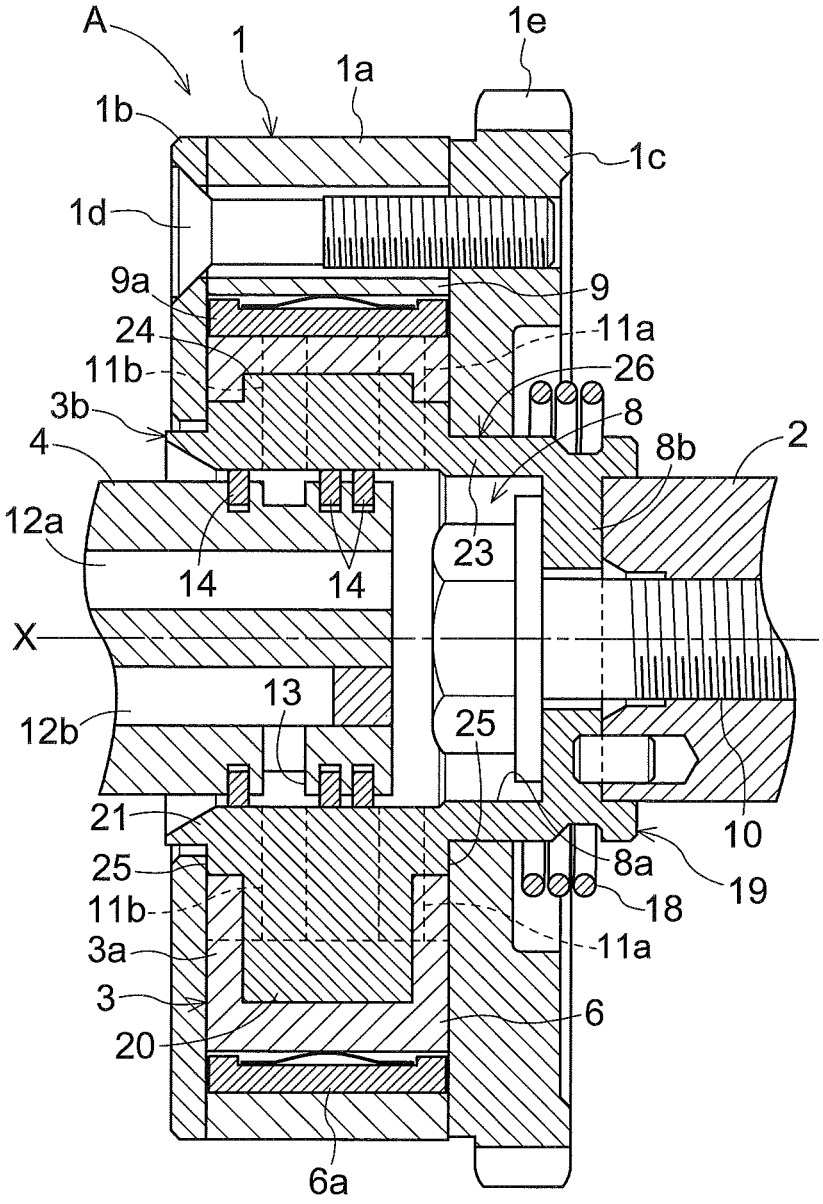
FIG. 6 is a vertical cross-sectional view showing a valve opening/closing timing control device according to a second embodiment.
Figure 7:
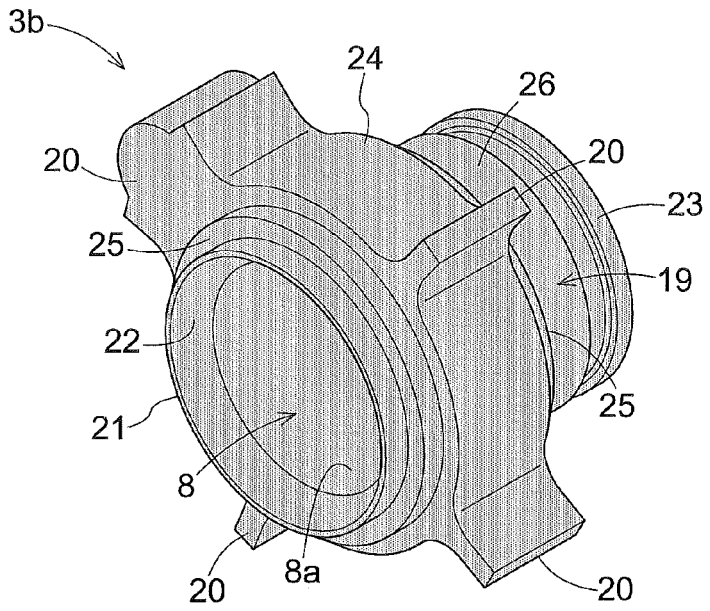
FIG. 7 is a perspective view of an inner circumferential member.
Figure 8:
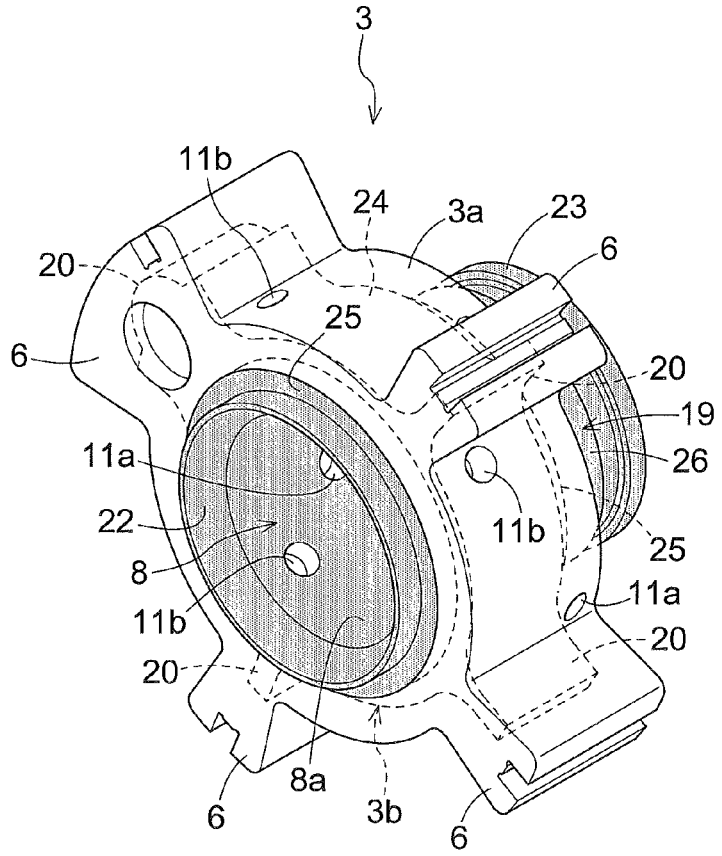
FIG. 8 is a perspective view of an inner rotor.

FIG. 6 to FIG. 8 show another embodiment of the present invention. In the present embodiment, two end surfaces 25 of the large-diameter portion 24 in the direction along the rotational axis X are formed to be slide-contact surfaces that have portions that are in contact with the front plate 1*b* and the rear plate 1*c* of the housing 1 along the entire circumference, as shown in FIG. 6.

Therefore, in the direction along the rotational axis X, the length of the outer circumferential member 3*a* is shorter than the length of the interval between the two end surfaces 25 of the large-diameter portion 24. In other words, the outer circumferential member 3*a* is provided so as not to protrude further than the two end surfaces 25 in the direction along the rotational axis X, and therefore, when the large-diameter portion 24 is enveloped in the outer circumferential member 3*a* using insert casting, the aluminum based material that has been fused is unlikely to attach to a slide-contact portion 26 of the small-diameter portion 23 that is in contact with the rear plate 1*c*. The other configurations are the same as those in the first embodiment.

Other Embodiments

1. In the valve opening/closing timing control device according to one aspect of the present invention, the outer circumferential member may be formed with a resin material that is lighter in weight than iron.

2. The valve opening/closing timing control device according to one aspect of the present invention may be a valve opening/closing timing control device that is to be installed to internal combustion engines for various purposes other than internal combustion engines for automobiles.

REFERENCE SIGNS LIST

1: driving rotating body
2: camshaft
3: driven rotating body
3*a*: outer circumferential member
3*b*: inner circumferential member
4: fixed shaft portion
5: fluid pressure chamber
5*a*: advancing chamber
5*b*: retarding chamber
6: partitioning portion
7: phase control unit
8*b*: coupling plate portion
11*a*: advancing channel
11*b*: retarding channel
19: cylindrical portion
20: protruding part
21: opening part
23: small-diameter portion
24: large-diameter portion
25: two end surfaces (slide-contact surfaces) of large-diameter portion
E: internal combustion engine
E1: crankshaft
X: rotational axis

The invention claimed is:

1. A valve opening/closing timing control device, comprising:

a driving rotating body that rotates in synchronization with a crankshaft of an internal combustion engine;

a driven rotating body that is located on an inner circumference side of the driving rotating body so as to be relatively rotatable, and that rotates in synchronization with a camshaft for opening/closing a valve of the internal combustion engine;

a fixed shaft portion by which an inner circumferential part of the driven rotating body is supported so as to be rotatable about a rotational axis that is the same as a rotational axis of the driving rotating body;

a fluid pressure chamber that is formed between the driving rotating body and the driven rotating body;

an advancing chamber and a retarding chamber that are formed by partitioning the fluid pressure chamber with a partitioning portion that is provided on an outer circumference side of the driven rotating body;

an advancing channel that is in communication with the advancing chamber, and a retarding channel that is in communication with the retarding chamber, the advancing channel and the retarding channel being formed in the driven rotating body; and a phase control unit for controlling a rotation phase of the driven rotating body relative to the driving rotating body such that a pressurized fluid is selectively supplied to or discharged from the advancing chamber or the retarding chamber via an inside of the fixed shaft portion and via the advancing channel or the retarding channel, wherein the driven rotating body has: an inner circumferential member that has a cylindrical portion into which the fixed shaft portion is inserted, and a coupling plate portion for coupling the camshaft to one end portion of the cylindrical portion, the cylindrical portion and the coupling plate portion being integrated with each other; and a cylindrical outer circumferential member that is located on an outer circumference side of the inner circumferential member and is provided with the partitioning portion, the outer circumferential member is provided with the inner circumferential member in a unified manner so as to have the same rotational axis, the inner circumferential member is formed with an iron-based material, and the outer circumferential member is formed with a material that is lighter in weight than the iron-based material, an opening part of the cylindrical portion extends further in a direction along the rotational axis than a part which is provided with the outer circumferential member in a unified manner.

2. The valve opening/closing timing control device according to claim 1, wherein the cylindrical portion has: a small-diameter portion that is provided with the coupling plate portion; and a large-diameter portion that is provided with a protruding part provided within a space defined inside the partitioning portion, that is continuous with the small-diameter part, and that has external dimensions that are greater than external dimensions of the small-diameter portion, the small-diameter portion and the large-diameter portion being integrated with each other, and the outer circumferential member is provided on the outer circumference side of the large-diameter portion in a unified manner.

3. The valve opening/closing timing control device according to claim 2, wherein two end surfaces of the large-diameter portion in a direction along the rotational axis have a part that is in contact with the driving rotating body, and a length of the outer circumferential member in the direction along the rotational axis is shorter than a length of an interval between the two end surfaces of the large-diameter portion in the direction along the rotational axis.

* * * * *